US011330945B2

(12) United States Patent
Brugora et al.

(10) Patent No.: US 11,330,945 B2
(45) Date of Patent: May 17, 2022

(54) CLEANING DEVICE

(71) Applicant: Carl Freudenberg KG, Weinheim (DE)

(72) Inventors: Alessandro Brugora, Cernusco sul Naviglio (IT); Helmut Hofmeister, Weinheim (DE)

(73) Assignee: CARL FREUDENBERG KG, Weinheim (DE)

( * ) Notice: Subject to any disclaimer, the term of this patent is extended or adjusted under 35 U.S.C. 154(b) by 161 days.

(21) Appl. No.: 16/967,140

(22) PCT Filed: Oct. 16, 2018

(86) PCT No.: PCT/EP2018/078255
§ 371 (c)(1),
(2) Date: Aug. 4, 2020

(87) PCT Pub. No.: WO2019/170265
PCT Pub. Date: Sep. 12, 2019

(65) Prior Publication Data

US 2020/0359863 A1 Nov. 19, 2020

(30) Foreign Application Priority Data

Mar. 9, 2018 (DE) ..... 10 2018 105 461.0

(51) Int. Cl.
*A47L 9/04* (2006.01)
*A47L 11/40* (2006.01)
(Continued)

(52) U.S. Cl.
CPC ..... *A47L 9/0477* (2013.01); *A47L 11/302* (2013.01); *A47L 11/4041* (2013.01);
(Continued)

(58) Field of Classification Search
CPC ..... A47L 7/00; A47L 7/0004; A47L 7/0014
See application file for complete search history.

(56) References Cited

U.S. PATENT DOCUMENTS 1,975,380 A 10/1934 Streich
3,699,607 A 10/1972 Putt
(Continued)

FOREIGN PATENT DOCUMENTS

CN 102949151 A 3/2013
CN 104470412 A 3/2015
(Continued)

*Primary Examiner* — Brian D Keller
*Assistant Examiner* — Sidney D Hohl
(74) *Attorney, Agent, or Firm* — Leydig, Voit & Mayer, Ltd.

(57) ABSTRACT

A cleaning device includes: a main body having a front edge; a suction device having a suction opening and a suction channel; a brush assembly having a rotatable roller brush; and an apparatus for wetting a floor to be cleaned with liquid, the apparatus being associated with the roller brush. The suction opening and the roller brush are arranged in the main body in such a manner as to face the floor to be cleaned. The suction opening has a first wall facing the front edge of the main body and a second wall facing the roller brush. The roller brush loosens dirt from the floor to be cleaned. A pivotable lip is associated with the suction opening and alternately rests against the first wall or the second wall.

12 Claims, 6 Drawing Sheets

(51) Int. Cl.
*A47L 11/30* (2006.01)
*A47L 9/14* (2006.01)

(52) U.S. Cl.
CPC ..... *A47L 11/4044* (2013.01); *A47L 9/14* (2013.01); *A47L 11/4088* (2013.01)

(56) References Cited

U.S. PATENT DOCUMENTS

| | | | | |
|---|---|---|---|---|
| 5,557,822 | A | 9/1996 | Yagi | |
| 6,189,174 | B1 | 2/2001 | Crouser | |
| 8,418,310 | B2 * | 4/2013 | Krebs ..... | A47L 11/34 15/322 |
| 9,265,394 | B2 | 2/2016 | Van Der Kooi | |
| 2011/0314632 | A1 | 12/2011 | Wood | |
| 2014/0182079 | A1 | 7/2014 | Van Der Kooi | |
| 2015/0074940 | A1 | 3/2015 | Guinot | |
| 2015/0135476 | A1 | 5/2015 | Eaglestone | |

FOREIGN PATENT DOCUMENTS

| | | | |
|---|---|---|---|
| CN | 205126117 | U | 4/2016 |
| DE | 2139157 | A | 2/1973 |
| DE | 60001818 | T2 | 12/2003 |
| DE | 202012103979 | U1 | 2/2012 |
| DE | 202013103961 | U1 | 9/2013 |
| EP | 2721988 | A2 | 4/2014 |
| GB | 2427351 | A | 12/2006 |

* cited by examiner

CLEANING DEVICE

CROSS-REFERENCE TO PRIOR APPLICATIONS

This application is a U.S. National Phase application under 35 U.S.C. § 371 of International Application No. PCT/EP2018/078255, filed on Oct. 16, 2018, and claims benefit to German Patent Application No. DE 10 2018 105 461.0, filed on Mar. 9, 2018. The International Application was published in German on Sep. 12, 2019 as WO 2019/170265 under PCT Article 21(2).

FIELD

The invention relates to a cleaning device comprising a main body, a suction device having a suction opening and a suction channel, and a brush assembly having a rotatable roller brush, wherein the suction opening and the roller brush are arranged in the main body in such a manner as to face the floor to be cleaned, wherein the suction opening has a first wall facing the front edge of the main body and a second wall facing the roller brush, wherein the roller brush is designed to loosen dirt from the floor to be cleaned, wherein an apparatus is furthermore provided to wet the floor to be cleaned with liquid and is associated with the roller brush.

BACKGROUND

Such a cleaning device is known from CN 205126117 U. The cleaning device enables combined dry and wet cleaning.

When the cleaning device is moved in one direction, the suction opening first comes into contact with the dirt on the floor to be cleaned. Particulate and dust-like dirt is conveyed through the suction opening and the suction channel into a dirt container. At the same time, the floor to be cleaned is wetted by means of the apparatus with a cleaning liquid which loosens dirt adhering to the floor. This dirt is then removed from the floor to be cleaned by the roller brush.

The suction opening is bordered along the longitudinal edge by two lips which project in the direction of the floor to be cleaned. The lips are required to maintain the necessary suction pressure for suctioning particulate and liquid dirt. In this embodiment, it is disadvantageous that the cross-sectional width of the suction opening is limited and, as a result, larger particles cannot be collected by the suction opening. Furthermore, during forward movement, the sealing lip assigned to the front side pushes parts of the particulate dirt in front of it like a clearing blade of a snow plow so that they do not pass into the suction channel. In addition, the sealing lip assigned to the roller brush can push a portion of the liquid to be collected in front of it, so that during backward movement it likewise cannot reach the suction channel.

SUMMARY

In an embodiment, the present invention provides a cleaning device, comprising: a main body having a front edge; a suction device having a suction opening and a suction channel; a brush assembly having a rotatable roller brush; and an apparatus configured to wet a floor to be cleaned with liquid, the apparatus being associated with the roller brush, wherein the suction opening and the roller brush are arranged in the main body in such a manner as to face the floor to be cleaned, wherein the suction opening has a first wall facing the front edge of the main body and a second wall facing the roller brush, wherein the roller brush is configured to loosen dirt from the floor to be cleaned, and wherein a pivotable lip is associated with the suction opening and alternately rests against the first wall or the second wall.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
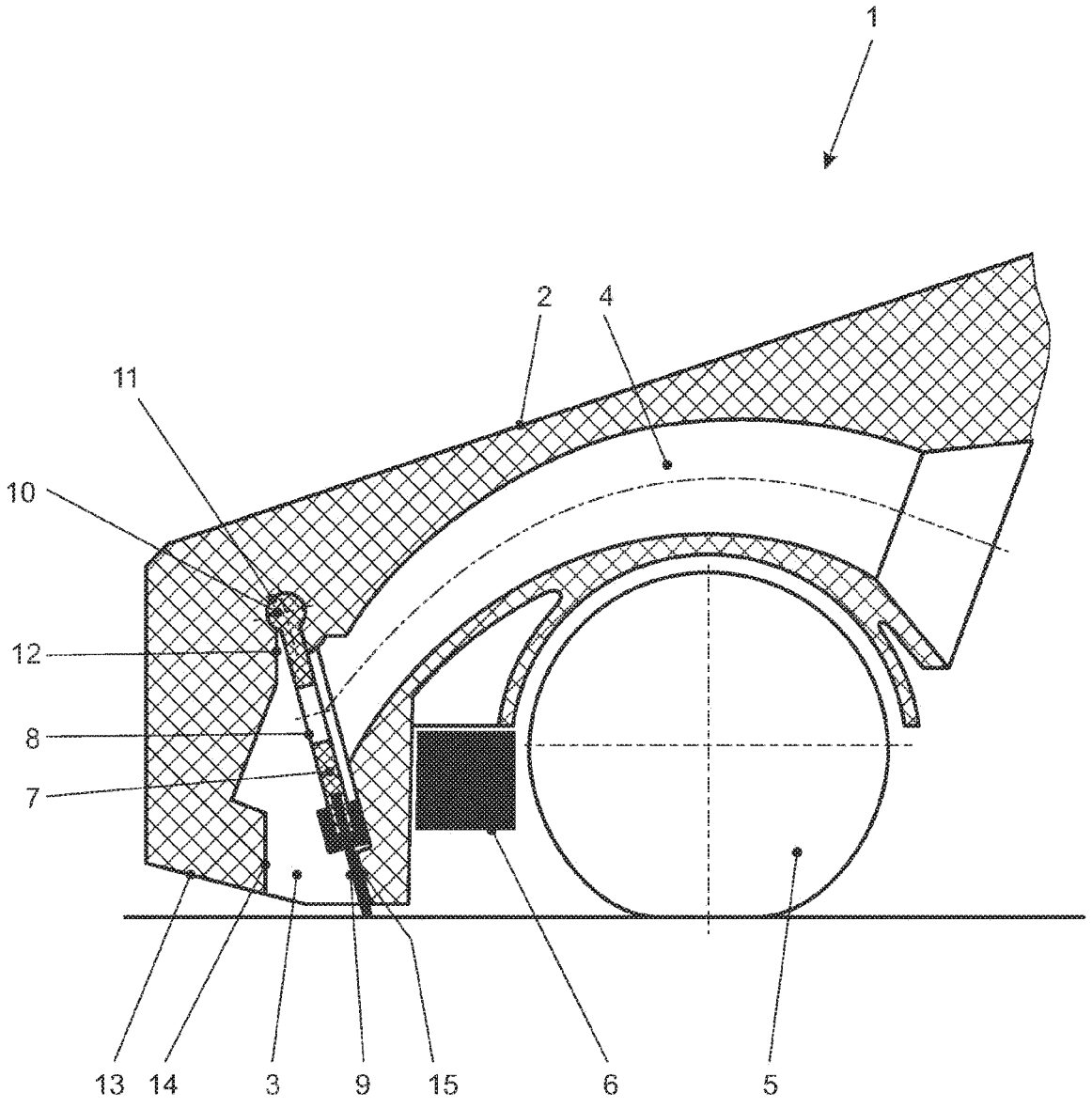
FIG. 1 shows the cleaning device in section with the lip resting against the second wall.

In an embodiment, the present invention provides a cleaning device which enables improved collection of particulate and damp dirt.

In an embodiment, a pivotable lip is associated with the suction opening and alternately rests against the first wall or the second wall of the suction opening. The alternating resting of the lip against the first wall or the second wall is preferably effected depending on the direction of movement of the cleaning device. If the cleaning device is moved in one direction, for example forward, the lip rests against the second wall facing the roller brush so that a gap opens along the front edge in the region of the first wall through which gap dirt, in particular particulate dirt, passes via the suction opening into the suction channel. During movement in the opposite direction, for example backward, the lip rests against the first wall so that a gap opens in the region of the second wall through which gap the dirt loosened by the roller brush and the liquid applied by the apparatus passes into the suction channel. In this embodiment, it is advantageous that the arrangement requires only a single lip. In particular, it is not necessary to separately border both longitudinal edges of the suction opening with a lip. By virtue of the fact that the lip is arranged pivotably in the main body, a larger cross-section for the suction opening can, on the one hand, be provided in the region of the front edge. As a result, it can collect larger particles. On the other hand, the lip functions as a squeegee lip in the other direction of movement and pushes the liquid in front of it so that it is collected by the suction opening.

The lip preferably rests on the floor to be cleaned. This ensures that the lip can pivot as a function of the direction of movement of the cleaning device. Furthermore, the suction power of the suction opening is in particular improved.

The lip can be shaped as a rocker arm and can be pivotably fixed in the main body. In this embodiment, the lip can have, along a longitudinal edge, a thickening arranged in a congruent recess of the main body.

A V-shaped slot through which the lip protrudes can be associated with the recess. This forms an undercut which fixes the lip in the main body. The V-shaped slot allows the lip to be pivotable.

According to an advantageous embodiment, the lip is positioned at an incline when the lip rests against the second wall and is positioned perpendicularly to the floor to be cleaned when the lip rests against the first wall. As a result, when the lip rests against the first wall, the lip rests under pretension on the floor to be cleaned. This increases the cleaning performance with respect to liquids. When the lip rests against the second wall, the pretension is less so that maneuvering the cleaning device is facilitated.

The lip can be provided with at least one hole. As a result, the lip can be arranged in the suction channel in such a way that it is arranged between the suction channel and the suction opening. When the lip rests against the second wall, the flow-conducting connection between the floor to be cleaned and the suction channel is established via the at least one hole. The hole may be formed in the form of a slot or in the form of a plurality of round or angular holes. When the lip rests against the first wall, there is no air flow through the at least one hole.

The lip can have an elastic section. The elastic section is preferably associated with the floor to be cleaned. The lip preferably comprises a rigid section and an elastic section.

Because of its smaller gap size, the second gap bordered by the second wall and the floor to be cleaned preferably has a smaller cross-section than the second gap bordered by the first wall and the floor to be cleaned. The resulting narrowing of the flow cross-section in the region of the second gap increases the suction pressure, which improves the collection of damp dirt, which mostly has a higher density.

The first gap bordered by the first wall and the floor to be cleaned accordingly has a larger gap size. Because of the increased gap size, particulate dirt, in particular larger particles, can be collected better.

The lip can be made of injection-moldable plastic, the rigid and elastic sections being produced in two-component injection molding and the elastic section being made of thermoplastic elastomer. The rigid section consists of a dimensionally stable plastic and enables a defined function of the lip.

The lip can have at least one, preferably a plurality of spacers along the edge associated with the floor to be cleaned. The spacers are designed and arranged on the lip in such a way that during the forward movement of the cleaning device, they come into contact with the floor to be cleaned and cause a narrow gap to form between the edge of the lip associated with the floor to be cleaned and the floor to be cleaned, on which gap the suction pressure acts. As a result, cleaning fluid can also be collected from the region of the apparatus at least partially during the forward movement.

The apparatus for wetting the floor to be cleaned with liquid can be designed as a drip mechanism. In an alternative embodiment, the apparatus can be designed as a spraying mechanism. The apparatus is designed to apply cleaning liquid to the floor to be cleaned in the form of drops or, in the case of the spraying mechanism, as a spray mist. The cleaning liquid loosens firmly adhering dirt.

The apparatus can be arranged between the roller brush and the suction opening. As a result, the cleaning liquid is applied to the floor to be cleaned in the immediate vicinity of the roller brush and the suction channel.

The roller brush can have a soft pile, for example of microfibers, on its circumference. Alternatively, soft or hard bristles can also be used.

The suction channel can be operatively connected to a suction blower. The suction blower is preferably operatively connected to an electric motor. This electric motor can be supplied with electric current via a mains connection or via a battery.

A dirt container can be arranged between the suction channel and the suction blower. The dirt container is preferably removably arranged in the main body.

The figures show a cleaning device 1 with a main body 2. A suction device with a suction opening 3 and a suction channel 4 and a brush assembly with a rotatable roller brush 5 are arranged in the main body 2. The suction opening 3 and the roller brush 5 are arranged in the main body 2 in such a manner as to face the floor to be cleaned.

The suction opening 3 has a first wall 14 facing the front edge 13 of the main body 2 and a second wall 15 facing the roller brush 5. A first gap results between the edge of the first wall 14 facing the floor to be cleaned and the floor to be cleaned. A second gap results between the edge of the second wall 15 facing the floor to be cleaned and the floor to be cleaned. The gap size, the clearance between edge and floor, is larger for the first gap than for the second gap. The first wall 14 and the second wall 15 extend transversely across the main body 2 and border the substantially rectangular suction opening 3.

The roller brush 5 is designed to loosen dirt from the floor to be cleaned. In the present embodiment, the roller brush 5 has a soft pile made of microfibers. Furthermore, an apparatus 6 for wetting the floor to be cleaned with liquid is associated with the main body 2. The apparatus 6 is arranged between the roller brush 5 and the suction opening 3. During the cleaning process, a cleaning liquid drips from the apparatus 6 onto the floor to be cleaned and loosens firmly adhering dirt. The loosened dirt is finally removed from the floor to be cleaned by the roller brush 5 and ultimately passes into the suction channel 4. In this respect, the apparatus 6 is associated with the roller brush 5.

A pivotable lip 7 is associated with the suction opening 3 and alternately rests against the first wall 14 or the second wall 15.

The lip 7 rests on the floor to be cleaned and is formed as a rocker arm and is pivotably fixed in the main body 2. For this purpose, the lip 7 has, along a longitudinal edge, a circular thickening 10 which is arranged in a congruently shaped recess 11 of the main body 2. The recess 11 opens out into a V-shaped slot 12 through which the lip 7 protrudes. The V-shaped slot 12 provides the rotational mobility of the lip 7.

The lip 7 is of substantially rectangular design and has an elastically formed section 9 which is associated with the floor to be cleaned. When the lip 7 rests against the first wall 14, the lip is oriented perpendicularly to the floor to be cleaned and rests under elastic pretension on the floor to be cleaned. When the lip 7 rests against the second wall 15, the lip is oriented at an incline to the floor to be cleaned so that the pretension against the floor to be cleaned is small. The lip 7 is furthermore provided with a substantially rectangular hole 8.

The suction channel 4 is operatively connected to a suction blower. The suction blower is in turn driven by an electric motor. The electric motor can be supplied with electrical energy by a battery or by a mains connection. A dirt container which is removably provided in the main body 2 is arranged between the suction channel 4 and the suction blower.

FIG. 1 shows the cleaning device 1 being guided over the floor to be cleaned in the direction of the front edge 13. This direction of movement can be understood as a forward movement. In this case, the lip 7 tilts and so rests against the second wall 15 of the main body 2. In this position, a flow-conducting connection of suction opening 3 and suction channel 4 is formed through the hole 8 of the lip 7. The cleaning liquid, which is applied to the floor to be cleaned by the apparatus 6 during this movement, comes into contact with the roller brush 5 after a short application time. The roller brush 5 then loosens firmly adhering dirt. At the same time, the suction opening 3 collects particulate dirt and conveys it through the suction channel 4 into the dirt container.

Figure 2:
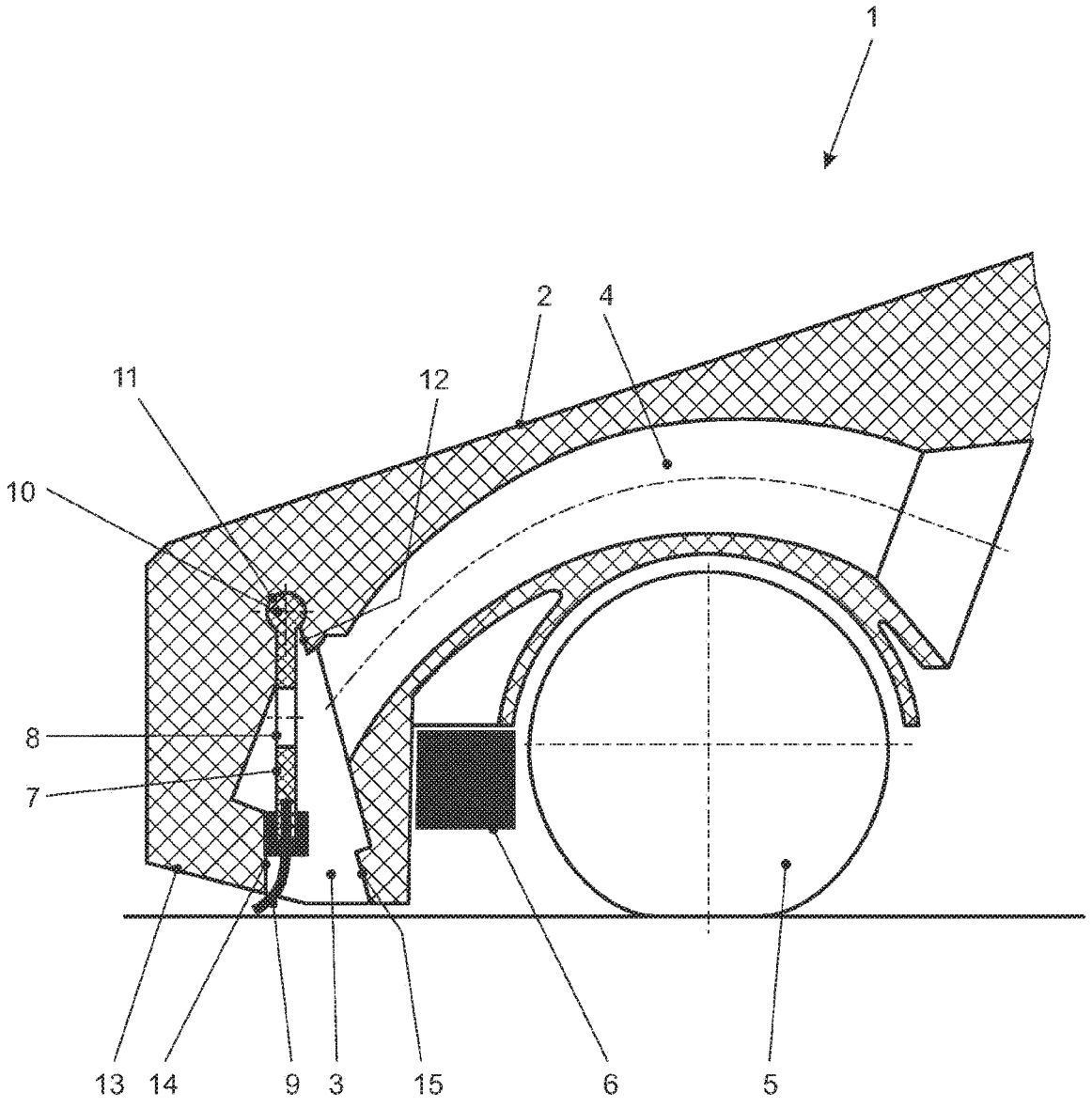
FIG. 2 shows the cleaning device in section with the lip resting against the first wall.

FIG. 2 shows the cleaning device 1 in a direction of movement in the direction of the roller brush 5. This direction of movement can be understood as backward movement. Here, the lip 7 tilts against the first wall 14 of the main body 2. In this case, the lip blocks the first gap between the first wall 14 and the floor to be cleaned. Furthermore, the lip 7 pushes dirt which has been loosened by the roller brush 5 and liquid in front of it during the backward movement so that both pass into the suction channel 4. Due to the small gap size of the second gap between the second wall 15 and the floor to be cleaned and the first gap blocked by the lip 7, a very high suction pressure develops which is suitable for collecting the cleaning liquid applied to the floor to be cleaned together with dirt loosened by the roller brush 5.

A handle for guiding the cleaning device 1 can be associated with the main body 2. In all alternative embodiments, the cleaning device 1 is designed as a cleaning robot.

Figure 3:
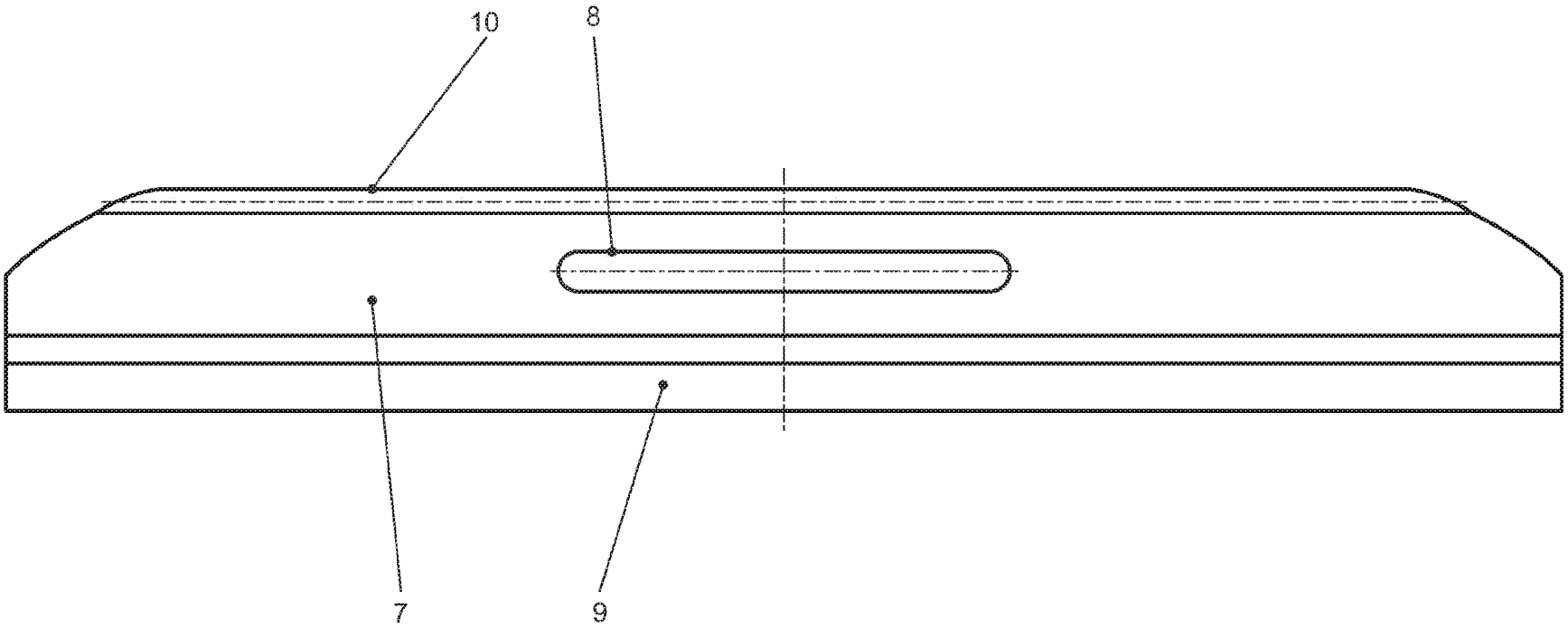
FIG. 3 shows a detail of the lip in a front view.

FIG. 3 shows a front view of the lip 7. The hole 8 which is introduced into the lip 7 is visible.

Figure 4:
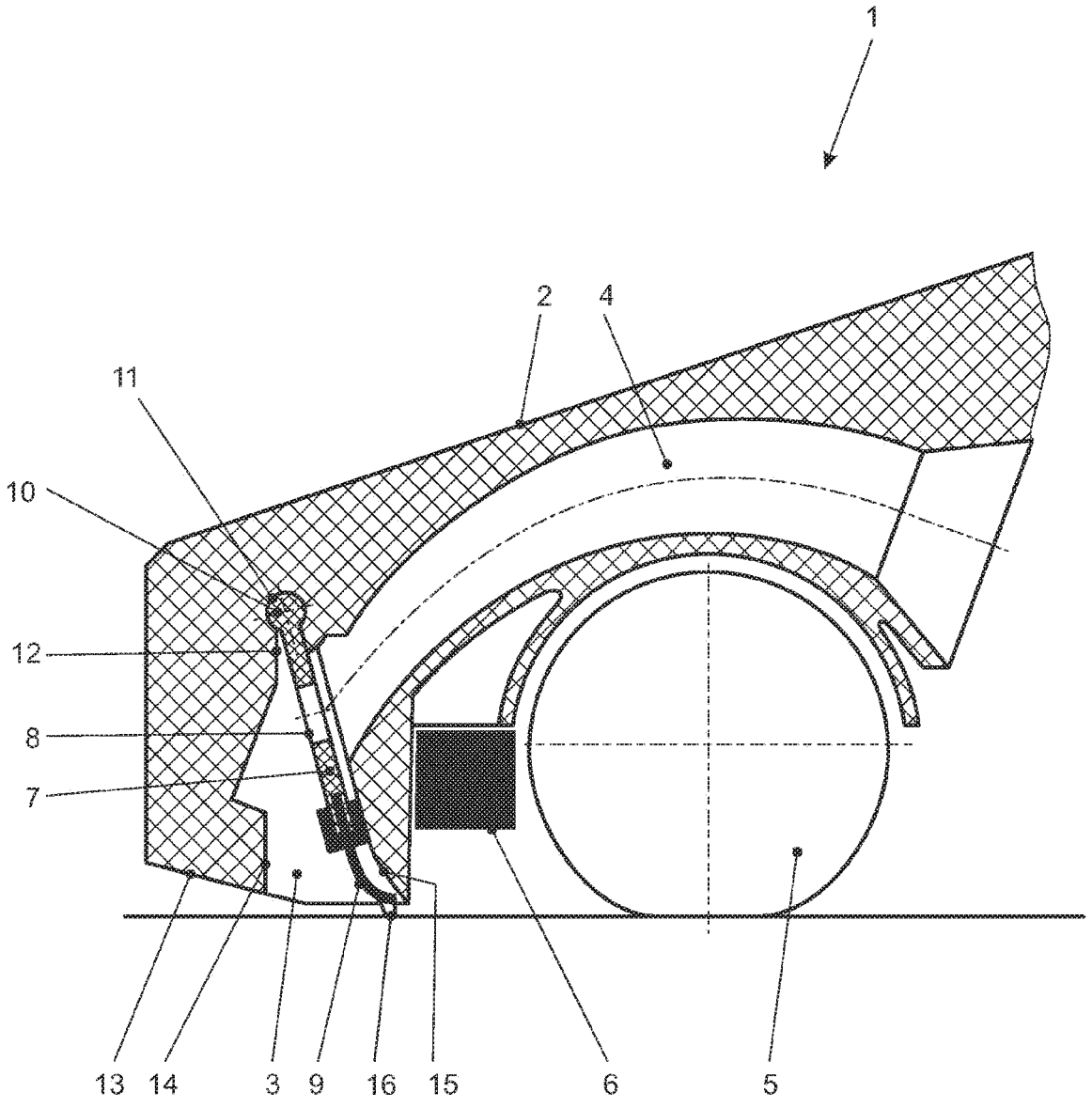
FIG. 4 shows the cleaning device of FIG. 1 with an alternatively designed lip.

FIG. 4 shows the cleaning device 1 of FIG. 1. In the present embodiment, the lip 7 is alternatively embodied and has a plurality of spacers 16 along the edge associated with the floor to be cleaned. During the forward movement of the cleaning device 1, the spacers 16 come into contact with the floor to be cleaned and cause a narrow gap to form between the edge of the lip 7 associated with the floor to be cleaned and the floor to be cleaned, on which gap the suction pressure acts. As a result, cleaning liquid can also be collected at least partially during the forward movement.

Figure 5:
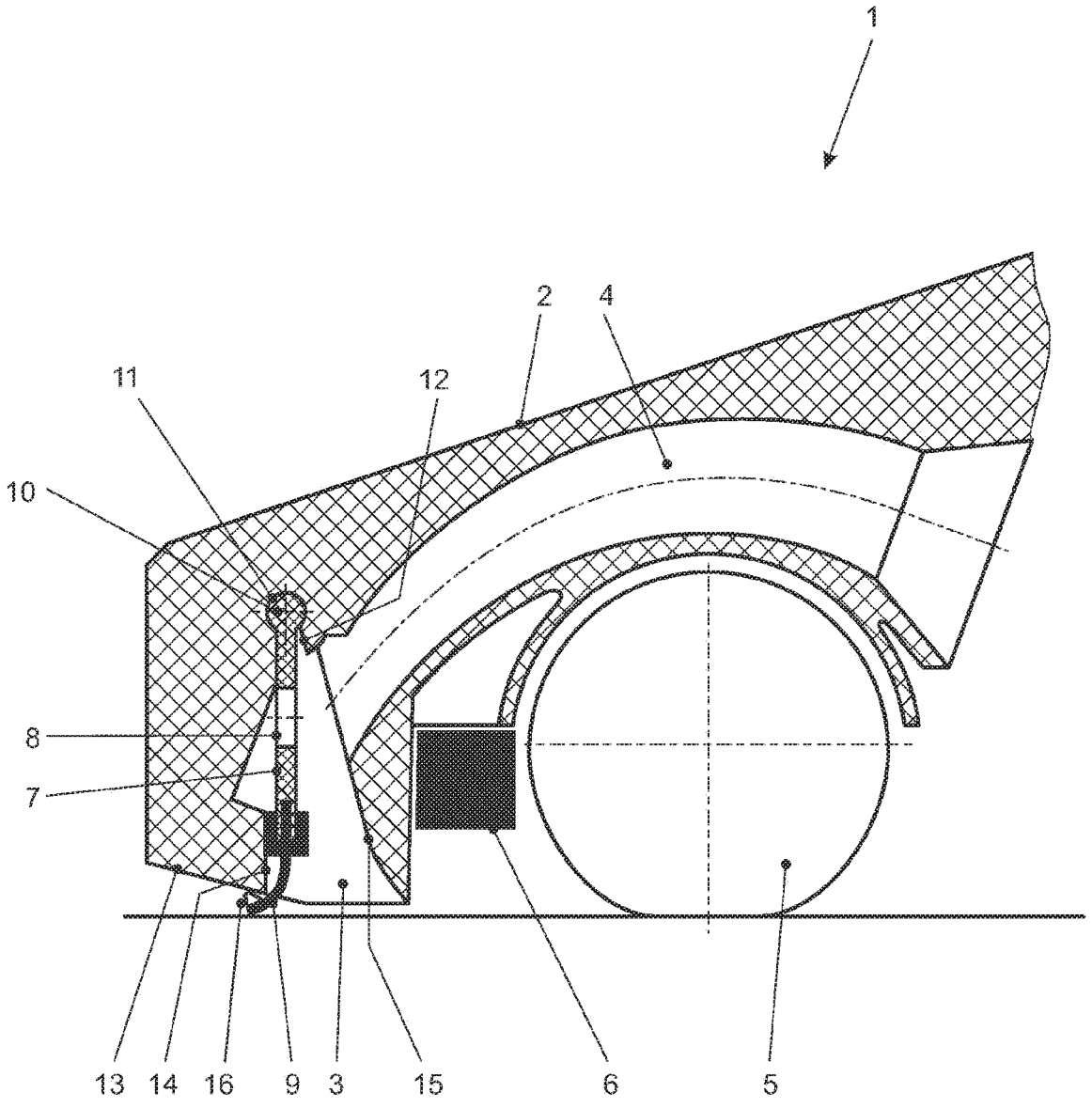
FIG. 5 shows the cleaning device of FIG. 2 with an alternatively designed lip.

FIG. 5 shows the cleaning device 1 with an alternatively embodied lip 7 during the backward movement analogous to FIG. 2. In this direction of movement, the edge of the lip 7 associated with the floor to be cleaned rests in a line on the floor to be cleaned. The spacers 16, however, are not in contact with the floor to be cleaned.

Figure 6:
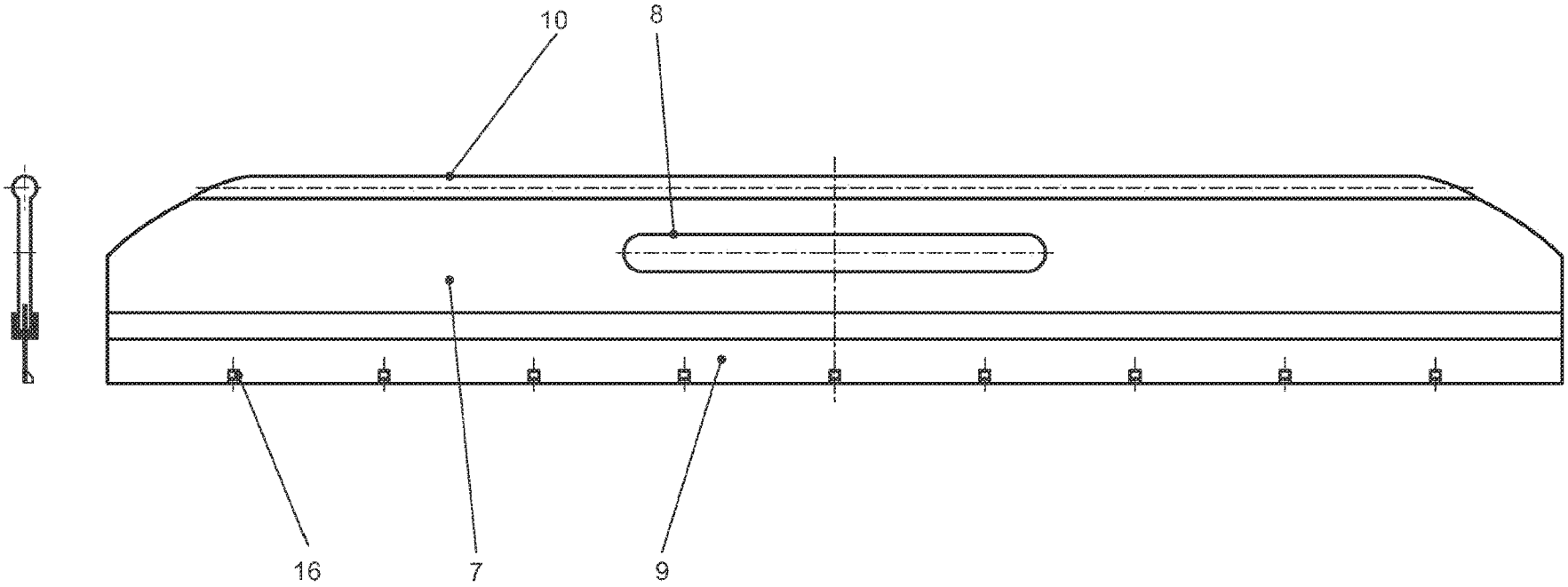
FIG. 6 shows a detail of the alternatively designed lip in a front view.

FIG. 6 shows a front view of the alternatively embodied lip 7. The hole 8 which is introduced into the lip 7 is visible. Furthermore, the spacers 16 arranged along the edge of the lip 7 associated with the floor to be cleaned are visible. The spacers 16 are of a uniform material and formed integrally with the lip 7 and are formed in the form of elevations.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A cleaning device, comprising:

a main body having a front edge;

a suction device having a suction opening and a suction channel;

a brush assembly having a rotatable roller brush; and an apparatus configured to wet a floor to be cleaned with liquid, the apparatus being associated with the roller brush, wherein the suction opening and the roller brush are arranged in the main body in such a manner as to face the floor to be cleaned, wherein the suction opening has a first wall facing the front edge of the main body and a second wall facing the roller brush, wherein the roller brush is configured to loosen dirt from the floor to be cleaned, and wherein a pivotable lip is associated with the suction opening and alternately rests against the first wall and the second wall.

2. The cleaning device according to claim 1, wherein the lip rests on the floor to be cleaned.

3. The cleaning device according to claim 1, wherein the lip is provided with at least one hole.

4. The cleaning device according to claim 1, wherein the lip has an elastically formed section.

5. The cleaning device according to claim 1, wherein the lip comprises a rocker arm and is pivotably fixed in the main body.

6. The cleaning device according to claim 5, wherein the lip rests under pretension on the floor to be cleaned when the lip rests against the first wall.

7. The cleaning device according to claim 1, wherein the lip has at least one spacer along the edge associated with the floor to be cleaned.

8. The cleaning device according to claim 1, wherein a gap forms in each case between the first wall and the floor to be cleaned and between the second wall and the floor to be cleaned.

9. The cleaning device according to claim 8, wherein the gap between the first wall and the floor to be cleaned has a larger gap size than the gap between the second wall and the floor to be cleaned.

10. The cleaning device according to claim 1, wherein the apparatus is arranged between the roller brush and the suction opening.

11. The cleaning device according to claim 1, wherein the suction channel is operatively connected to a suction blower.

12. The cleaning device according to claim 11, wherein a dirt container is arranged between the suction channel and the suction blower.

* * * * *